US009514903B2

(12) United States Patent
Kim

(10) Patent No.: US 9,514,903 B2
(45) Date of Patent: Dec. 6, 2016

(54) GAS-INSULATED CIRCUIT BREAKER

(71) Applicant: Hyundai Heavy Industries Co., Ltd., Ulsan (KR)

(72) Inventor: Hyung-Choon Kim, Ulsan (KR)

(73) Assignee: Hyundai Heavy Industries Co., Ltd., Ulsan (KR)

( * ) Notice: Subject to any disclaimer, the term of this patent is extended or adjusted under 35 U.S.C. 154(b) by 0 days.

(21) Appl. No.: 14/531,618

(22) Filed: Nov. 3, 2014

(65) Prior Publication Data

US 2015/0294818 A1 Oct. 15, 2015

(30) Foreign Application Priority Data

Apr. 9, 2014 (KR) ..... 10-2014-0042298

(51) Int. Cl.
*H01H 33/64* (2006.01)
*H01H 33/74* (2006.01)
(Continued)

(52) U.S. Cl.
CPC ..... *H01H 33/64* (2013.01); *H01H 33/025* (2013.01); *H01H 33/74* (2013.01); *H01H 33/91* (2013.01); *H01H 2033/888* (2013.01)

(58) Field of Classification Search
CPC ..... H01H 33/025; H01H 33/08; H01H 33/64; H01H 33/90; H01H 2033/888; H01H 33/74; H01H 33/91
(Continued)

(56) References Cited

U.S. PATENT DOCUMENTS 4,471,187 A 9/1984 Sturzenegger et al.
4,516,006 A * 5/1985 Kobayashi ..... H01H 33/91 218/57
(Continued)

FOREIGN PATENT DOCUMENTS

CN 1143257 A 2/1997
CN 1941243 A 4/2007
(Continued)

OTHER PUBLICATIONS

Office Action for Corresponding Korean Application No. KR1020140042298; dated Aug. 28, 2015.
(Continued)

*Primary Examiner* — Renee Luebke
*Assistant Examiner* — William Bolton
(74) *Attorney, Agent, or Firm* — Locke Lord LLP; Christopher J. Capelli

(57) ABSTRACT

A gas-insulated circuit breaker may include: a fixed contact having a hollow formed therein; a fixed arc contact disposed in the hollow of the fixed contact; a fixed-side conductor provided to surround the fixed contact and configuring a gap between the fixed-side conductor and the fixed contact as a discharge path for an insulation gas; a movable contact having a hollow formed therein; a movable arc contact disposed in the hollow of the movable contact; a movable-side conductor provided to surround the movable contact and configuring a gap between the movable-side conductor and the movable contact as a discharge path for an insulation gas; a first extension part formed on the fixed-side conductor and extending the discharge path for the insulation gas of the fixed-side conductor; and a second extension part formed on the movable-side conductor and extending the discharge path for the insulation gas of the movable-side conductor.

3 Claims, 3 Drawing Sheets

(51) Int. Cl.
*H01H 33/91* (2006.01)
*H01H 33/02* (2006.01)
*H01H 33/88* (2006.01)

(58) Field of Classification Search
USPC ..... 218/51, 52, 57, 63, 65, 116, 97
See application file for complete search history.

(56) References Cited

U.S. PATENT DOCUMENTS

| | | | | |
|---|---|---|---|---|
| 7,763,821 | B2 * | 7/2010 | Yoshitomo | H01H 33/7015 218/59 |
| 7,816,924 | B2 * | 10/2010 | Kanazawa | H01H 1/0015 324/415 |
| 2005/0173378 | A1 | 8/2005 | Nowakowski | |
| 2007/0068904 | A1 * | 3/2007 | Dahlquist | H01H 33/74 218/59 |
| 2007/0272659 | A1 * | 11/2007 | Saxl | H01H 33/24 218/149 |
| 2008/0053961 | A1 * | 3/2008 | Grieshaber | H01H 33/24 218/157 |
| 2013/0168357 | A1 * | 7/2013 | Yaginuma | H01H 33/08 218/57 |

FOREIGN PATENT DOCUMENTS

| | | | |
|---|---|---|---|
| CN | 101064226 | A | 10/2007 |
| DE | 10221580 | B3 | 1/2004 |
| EP | 0075668 | A2 | 4/1983 |
| EP | 1768150 | A1 | 3/2007 |
| KR | 1020100024267 | | 3/2010 |
| KR | 101291789 | B1 | 7/2013 |

OTHER PUBLICATIONS

Extended European Search Report for Corresponding European Application No. EP14194556.8; dated Sep. 12, 2015.
Office Action for Corresponding Chinese Patent Application No. CN201410758326.0, dated Sep. 20, 2016.

* cited by examiner

GAS-INSULATED CIRCUIT BREAKER

CROSS-REFERENCE TO RELATED APPLICATION

This application claims the benefit of Korean Patent Application No. 10-2014-0042298 filed on Apr. 9, 2014, with the Korean Intellectual Property Office, the disclosure of which is incorporated herein by reference.

BACKGROUND

The present disclosure relates to a gas-insulated circuit breaker and more particularly, to a gas-insulated circuit breaker having a structure allowing an insulation gas having been discharged from a breaker unit into an enclosure to be cooled.

In general, gas-insulated circuit breakers refer to devices for opening and closing a load device or interrupting a current in the event of an accident such as earthing or grounding, short-circuits, or the like, in power transmission and transformation systems or electrical circuits.

Such gas-insulated circuit breakers may be classified as vacuum circuit breakers (VCB), oil circuit breakers (OCB) gas circuit breakers (GCB) and the like, depending on an arc-extinguishing medium utilized therein.

In addition, a gas-insulated circuit breaker may have an insulating material provided within a pressure container, a movable contact and a fixed contact having a main contact and an arc contact in the interior of the insulating material, and the like, to thereby extinguish an arc generated at a point of contact between the main contact and the arc contact of the movable contact and the fixed contact.

FIG. 1 is a cross-sectional view of a gas-insulated circuit breaker according to the related art.

Referring to FIG. 1, the gas-insulated circuit breaker according to the related art may be configured of a fixed contact part and a movable contact part.

The fixed contact part may include a fixed contact member 20, a fixed arc contact member 30, and a fixed-side shield 25. The fixed contact part may further include a cylindrical fixed conductor part 10, and the fixed contact member 20 may be coupled to one end of the fixed conductor part 10.

In addition, in the fixed contact part, the fixed arc contact member 30 may be positioned within the fixed conductor part 10.

The movable contact part may include a movable contact member 50, a movable arc contact member 60, an external nozzle 71, an internal nozzle 72, and a movable axis 80. The movable contact member 50 may be inserted into the fixed contact member 20.

The movable arc contact member 60 may receive the fixed arc contact member 30 therein. The external nozzle 71 may be coupled to the inside of the movable contact member 50.

The internal nozzle 72 may surround the movable arc contact member 60 to be spaced apart from the movable arc contact member 60 and may be configured to be spaced apart from the external nozzle 71 to provide a transfer path for an insulating gas.

The movable axis 80 may have one end to which the internal nozzle 72 is coupled, and the movable arc contact member 60 may be coupled to the interior of the one end to which the internal nozzle 72 is coupled. In addition, in a case in which a device guiding a gas flow to the movable axis is not present, an insulation gas heated to a high temperature may be induced to flow within the movable contact part 40 overall.

Meanwhile, during a breaking operation of the gas-insulated circuit breaker, when the fixed arc contact member 30 and the movable arc contact member 60 are separated from each other, an arc may be generated due to a difference in voltage levels in both terminals thereof.

In this case, a cylinder 90 coupled to the movable axis 80 in order to break the generated arc may move back according to a withdrawal operation of the movable axis 80, such that an insulation gas filling the interior of the cylinder 90 such as SF may be sprayed into a space between the fixed arc contact member 30 and the movable arc contact member 60.

Here, the sprayed insulation gas may be in a high-temperature and high-pressure state due to the arc and a supersonic flow toward the fixed contact part and the movable contact part may be generated.

The insulation gas in a high-temperature and high-pressure state may be discharged from a breaker unit into an internal space of an enclosure.

However, in the case of the high temperature insulation gas, insulating properties may be remarkably degraded. The gas having degraded insulating properties may cause electrical breakdown between earths (between an enclosure and a breaker unit) and between phases (between multiphase breaker units).

Meanwhile, in a gas-insulated circuit breaker according to the related art, in order to facilitate the formation of an electrical field, that is, in order to generate a quasi-uniform electric field, the fixed conductor part 10 and a movable conductor part 40 are configured to have a cylindrical shape, and the enclosure accommodating the breaker unit therein may also be formed to have a cylindrical shape.

However, since the fixed conductor part 10 and the movable conductor part 40 configured to have a cylindrical shape as described above may have a narrow channel through which an insulation gas is discharged, a cooling degree of the insulation gas may be low when the insulation gas is discharged.

SUMMARY

An aspect of the present disclosure may provide a gas-insulated circuit breaker capable of efficiently cooling a high temperature insulation gas that has extinguished an arc.

According to an aspect of the present disclosure, a semiconductor device may include a fixed contact having a hollow formed therein; a fixed arc contact disposed in the hollow of the fixed contact; a fixed-side conductor provided to surround the fixed contact and configuring a gap between the fixed-side conductor and the fixed contact as a discharge path for an insulation gas; a movable contact having a hollow formed therein; a movable arc contact disposed in the hollow of the movable contact; a movable-side conductor provided to surround the movable contact and configuring a gap between the movable-side conductor and the movable contact as a discharge path for an insulation gas; a first extension part formed on the fixed-side conductor and extending the discharge path for the insulation gas of the fixed-side conductor; and a second extension part formed on the movable-side conductor and extending the discharge path for the insulation gas of the movable-side conductor.

The first extension part may be formed by bending a portion of a body of the fixed-side conductor outwardly; and the second extension part may be formed by bending a portion of a body of the movable-side conductor outwardly.

The fixed-side conductor may have a cylindrical shape in which at least one first extension part is formed on a side of the fixed-side conductor, and the movable-side conductor may have a cylindrical shape in which at least one second extension part is formed on a side of the movable-side conductor.

The fixed-side conductor and the movable-side conductor may have discharge apertures in front ends thereof, the discharge apertures allowing the insulation gas to be discharged outwardly there through.

The gas-insulated circuit breaker may further include a puffer cylinder in the movable contact, the puffer cylinder spraying the insulation gas into a gap between the fixed arc contact and the movable arc contact according to an operation of separating the movable contact from the fixed contact.

BRIEF DESCRIPTION OF DRAWINGS

The above and other aspects, features and other advantages of the present disclosure will be more clearly understood from the following detailed description cut in conjunction with the accompanying drawings, in which.

DETAILED DESCRIPTION

Figure 1:
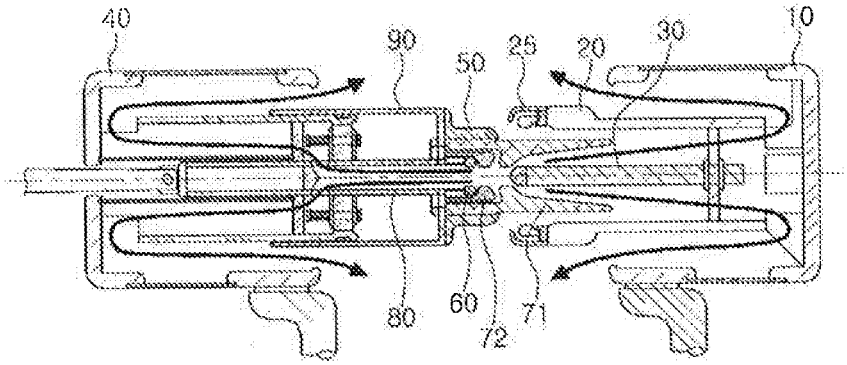
PRIOR ART FIG. 1
FIG. 1 is a cross-sectional view of a gas-insulated circuit breaker according to the related art.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Figure 2:
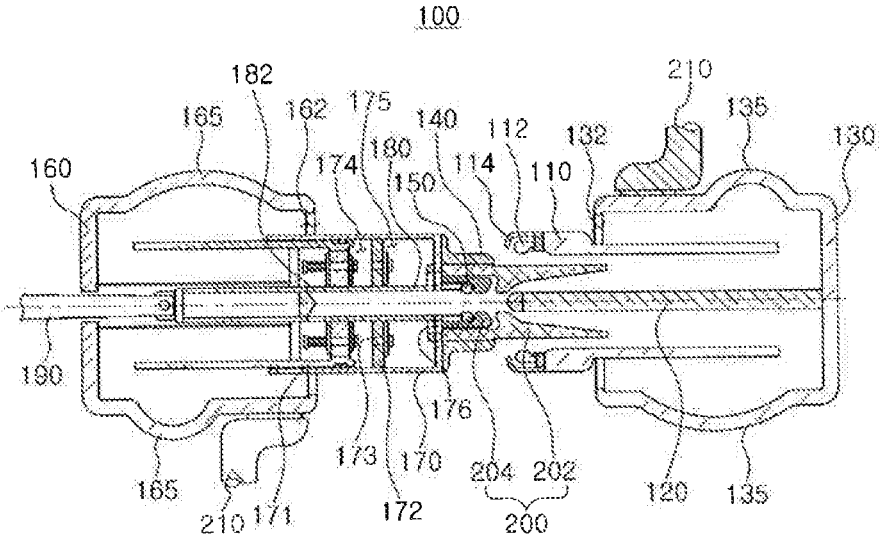
FIG. 2 is a cross-sectional view of a gas-insulated circuit breaker according to an exemplary embodiment of the present disclosure.
Figure 3:
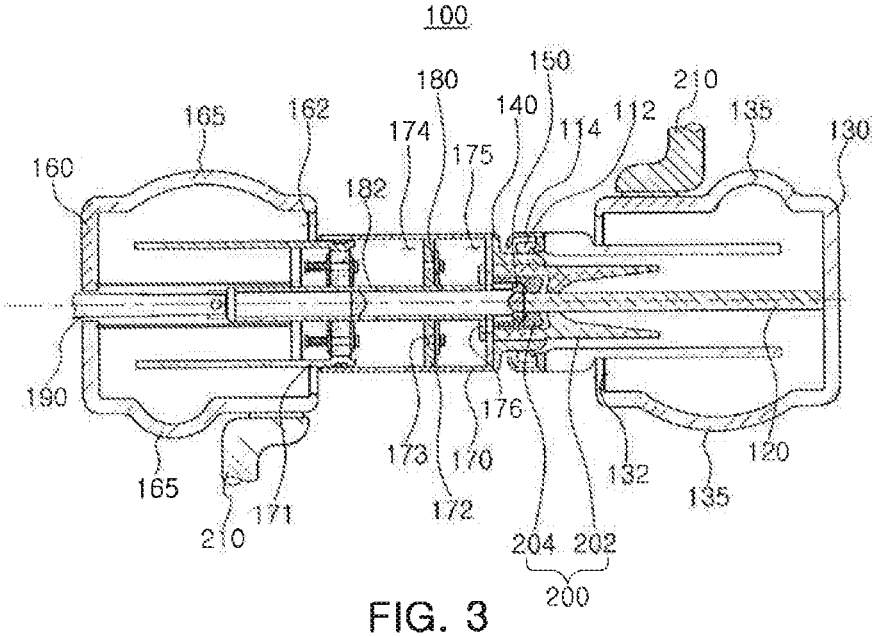
FIG. 3 is a cross-sectional view illustrating a closed state of the gas-insulated circuit breaker shown in FIG. 2.
Figure 4:
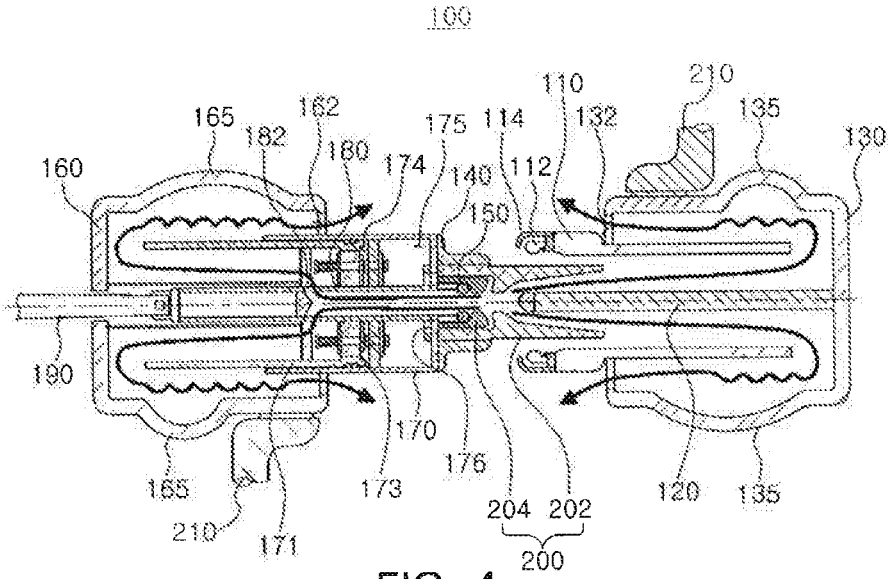
FIG. 4 is a cross-sectional view illustrating an open state of the gas-insulated circuit breaker shown in FIG. 2.

Referring to FIGS. 2 to 4, a gas-insulated circuit breaker according to an exemplary embodiment of the present disclosure will be described.

As illustrated in FIGS. 2 to 4, a gas-insulated circuit breaker 100 according to an exemplary embodiment of the present disclosure may include a fixed contact 110, a fixed arc contact 120, a fixed-side conductor 130, a movable contact 140, a movable arc contact 150, a movable-side conductor 160, a movable rod 180, an insulating rod 190, a puffer cylinder 170, nozzles 200, and first extension parts 135 and second extension parts 165.

The fixed contact 110 may be connected to the movable contact 140 to be described later, to form a path along which a main current flows.

The fixed contact 110 may be configured as a cylindrical conductor having a hollow formed therein, and may include a finger contact portion 112 formed on a front end thereof and pressing and grasping the movable contact 140 to be described later, and a shielding portion 114 provided to surround a circumference of the finger contact portion 112 and alleviating an electrical field.

In addition, the fixed arc contact 120 may be configured as a bar shaped conductor disposed in the hollow of the fixed contact 110 and may induce an arc according to an open or closed state of the gas-insulated circuit breaker 100 to thereby prevent an arc from being generated in the fixed contact 110 and the movable contact 140.

The fixed arc contact 120 may be inserted into and coupled to the movable arc contact 150 to be described later during the closed state of the gas-insulated circuit breaker 100.

In addition, the fixed-side conductor 130 may be configured as a conductor having an internal space in which the fixed contact 110 and the fixed arc contact 120 are provided.

The fixed-side conductor 130 may be connected to the fixed contact 110 to configure a path along which a main current flows.

The fixed contact 110 may be provided in the internal space of the fixed-side conductor 130, such that the fixed-side conductor 130 may surround the fixed contact 110 and a gap between the fixed contact 110 and the fixed-side conductor 130 may be configured as a discharge path through which an insulation gas is discharged.

In other words, the insulation gas sprayed into the fixed arc contact 120 during a breaking operation of the gas-insulated circuit breaker 100 may flow through the gap between the fixed contact 110 and the fixed-side conductor 130 as illustrated in FIG. 4, and may be discharged into the interior of an enclosure (not shown).

To this end, in an exemplary embodiment, the fixed-side conductor 130 may be provided with a discharge aperture 132 in a front end thereof, the discharge aperture 132 allowing the insulation gas to be discharged there through.

In addition, in an exemplary embodiment, the fixed-side conductor 130 may be generally configured to have a cylindrical shape in order to form a quasi-uniform electric field.

In addition, the movable contact 140 may be configured as a cylindrical conductor having a hollow formed therein. The movable contact 140 may be connected to the movable rod 180 to be described later, and may be operated according to an operation of the movable rod 180.

In an exemplary embodiment, the movable contact 140 may be insertedly connected to the finger contact portion 112 of the fixed contact 110. The movable contact 140 may be connected to the fixed contact 110 to configure a path along which a main current flows.

In addition, the movable arc contact 150 may be inserted into the hollow of the movable contact 140 and may be configured as a cylindrical conductor having a hollow formed therein.

The fixed arc contact 120 may be insertedly coupled to the hollow of the movable arc contact 150 in the closed state of the gas-insulated circuit breaker 100.

The movable arc contact 150 may induce an arc in conjunction with the fixed arc contact 120 according to the open or closed state of the gas-insulated circuit, breaker 100 and prevent the occurrence of the arc in the fixed contact 110 and the movable contact 140.

In addition, the movable-side conductor 160 may be configured to surround the movable contact 140 and a gap between the movable-side conductor 160 and the movable contact 140 may be configured as a path for discharging an insulation gas. The movable-side conductor 160 may be provided with a discharge aperture 152 in a front end thereof, the discharge aperture 162 allowing the insulation gas to be discharged there through.

In an exemplary embodiment of the present disclosure illustrated in FIGS. 2 to 4, the puffer cylinder 170 and a piston portion 171 to be described later may be disposed inside the movable-side conductor 160, and the movable contact 140 may be disposed in front of the movable-side conductor 150, but it could be understood that the movable contact 140 may be a movable portion in which a current flows and encompass a concept including the puffer cylinder 170 and the piston portion 171.

That is, the discharge path for the insulation gas, configured in the movable-side conductor 160 may be formed as the gap between the movable-side conductor 160 and the movable contact 140 in the case of an exemplary embodiment including no puffer cylinder 170, and may be formed as a gap between the puffer cylinder 170 and the piston portion 171.

In an exemplary embodiment, the movable-side conductor 160 may be configured as a conductor having an internal space, and the movable rod 180 and the puffer cylinder 170 to be described later may be disposed in the internal space of the movable-side conductor 160.

The movable-side conductor 160 may be connected to the movable contact 140 to configure a path along which a main current flows.

In an exemplary embodiment, the movable-side conductor 160 may be generally configured to have a cylindrical shape in order to form a quasi-uniform electric field, similarly to the fixed-side conductor 130.

In addition, the movable rod 180 may be coupled to the movable contact 140 and the movable arc contact 150, and may be configured to perform a reciprocating movement in a length direction through an external driving apparatus (not shown).

That is, the movable rod 180 may transfer force applied from an external driving apparatus to the movable contact 140 and the movable arc contact 150, such that the movable contact 140 and the movable arc contact 150 may be moved.

The movable rod 180 may be connected to the insulating rod 190 so as to receive mechanical force from an external driving apparatus through the insulating rod 190.

In addition, the puffer cylinder 170 may be provided on the movable contact 140 and may spray the insulation gas into a gap between the fixed arc contact 120 and the movable arc contact 150 according to an operation of separating the movable contact 140 from the fixed contact 110, that is, during the open state of the gas-insulated circuit breaker 100.

In an exemplary embodiment, the puffer cylinder 170 may be configured as a cylindrical member having an open rear end, and may be provided with a spray aperture 176 through which the insulating gas filling the interior of the puffer cylinder 170 is sprayed.

In addition, the puffer cylinder 170 may have the piston portion 171 inserted within the puffer cylinder 170 and compressing the insulation gas.

In addition, in an exemplary embodiment, a partition portion 172 may be provided in the puffer cylinder 170, the partition portion 172 dividing an enclosed space surrounded by the inside of the puffer cylinder 170 and a front end of the piston portion 171 into two enclosed spaces.

Through the partition portion 172, a first chamber 174 and a second chamber 175 may be configured in the puffer cylinder 170. The first and second chambers 174 and 175 may be filled with the insulation gas at a high degree of pressure.

Further, the partition portion 172 may be coupled to the movable rod 180 and may enable the puffer cylinder 170 to be operated according to the operation of the movable rod 180.

That is, in an exemplary embodiment of the present disclosure, when the movable rod 180 moves backwards during the open state of the gas-insulated circuit breaker 100, the puffer cylinder 170 coupled to the movable rod 180 may be retreated and in this case, since the cylinder part may be in a fixed state, the volume of the first chamber 174 may be decreased and thus, an insulation gas filling the interior of the first chamber 174 may pressurize an insulation gas filling the interior of the second chamber 175 through a circulation aperture 173 of the partition portion 172, so that the insulation gas filling the interior of the second chamber 175 may be sprayed out via the nozzles 200 to be described later.

In addition, the nozzles 200 may be provided to spray the insulation gas sprayed from the spray aperture 176 of the puffer cylinder 170, into a space between the fixed arc contact 120 and the movable arc contact 150.

In an exemplary embodiment, the nozzles 200 may be coupled to the hollow of the movable contact 140 and may configured to include an external nozzle 202 having a hollow and an internal nozzle 204 spaced apart from the hollow of the external nozzle 202 and covering the outside of the movable arc contact 150.

In this case, the insulation gas may be sprayed into a gap between the external nozzle 202 and the internal nozzle 204.

Meanwhile, the first extension parts 135 may be formed on the fixed-side conductor 130 and may extend at least a portion of the discharge path for the insulation gas of the fixed-side conductor 130.

In an exemplary embodiment, as illustrated in FIGS. 2 to 4, each of the first extension parts 135 may be formed by bending a portion of a body of the fixed-side conductor 130 to be protruded outwardly.

The first extension parts 135 may expand the volume of the discharge path for the insulation gas of the fixed-side conductor 130, whereby a cooling rate of the insulation gas discharged from the fixed-side conductor 130 may be increased.

That is, when the insulation gas passes through the first extension parts 135, a temperature thereof may be lowered due to a decrease in a degree of pressure thereof.

In an exemplary embodiment, at least one first extension part 135 may be formed on a side of the fixed-side conductor 130. By way of example, as illustrated in FIGS. 2 to 4, the first extension parts 135 may be formed to correspond to each other on both sides of the fixed-side conductor 130, but are not limited thereto. The first extension part may be only formed on one side of the fixed-side conductor 130.

Meanwhile, the second extension parts 165 may be formed on the movable-side conductor 160 and may extend at least a portion of the discharge path for the insulation gas of the movable-side conductor 160.

In an exemplary embodiment, as illustrated in FIGS. 2 to 4, each of the second extension parts 165 may be formed by bending a portion of a body of the movable-side conductor 160 to be protruded outwardly.

The second extension parts 165 may expand the volume of the discharge path for the insulation gas of the movable-side conductor 160, whereby a cooling rate of the insulation gas discharged from the movable-side conductor 160 may be increased.

In an exemplary embodiment, at least one second extension part 165 may be formed on a side of the movable-side conductor 160. By way of example, as illustrated in FIGS. 2 to 4, the second extension parts 165 may be formed to correspond to each other on both sides of the movable-side conductor 160, but are not limited thereto. The second extension part may be only formed on one side of the movable-side conductor 160.

Operations during the open state of the gas-insulated circuit breaker 100 will be described.

As illustrated in FIG. 4, when the fixed arc contact 120 and the movable arc contact 150 are separated from each other according to the operation of the movable rod 180, an insulation gas may be sprayed from the puffer cylinder 170 into the space between the fixed arc contact 120 and the movable arc contact 150, through the nozzles 200, to thereby extinguish an arc.

A portion of the insulation gas in a high temperature and high pressure state that has extinguished the arc may move to a rear end of the fixed contact 110 through the internal space of the fixed contact 110, may flow through the gap between the fixed-side conductor 130 and the fixed contact 110, and may be discharged into the interior of the enclosure via the discharge aperture 132 of the fixed-side conductor 130.

In this case, while the insulation gas passes through the first extension parts 135, the temperature thereof may be lowered.

A remainder portion of the insulation gas in a high temperature and high pressure state that has extinguished the arc may be introduced into the inside of the movable rod 180 through the hollow of the movable contact 140, and subsequently, be discharged into the interior of the piston portion 171 through a discharge aperture 182 provided in a rear end of the movable rod 180.

Here, the insulation gas discharged into the interior of the piston portion 171 may flow through a gap between the movable-side conductor 160 and the piston portion 171 and be discharged into the interior of the enclosure through the discharge aperture 162 of the movable-side conductor 160.

In this case, while the insulation gas passes through the second extension parts 165, the temperature thereof may be lowered.

Figure 5:
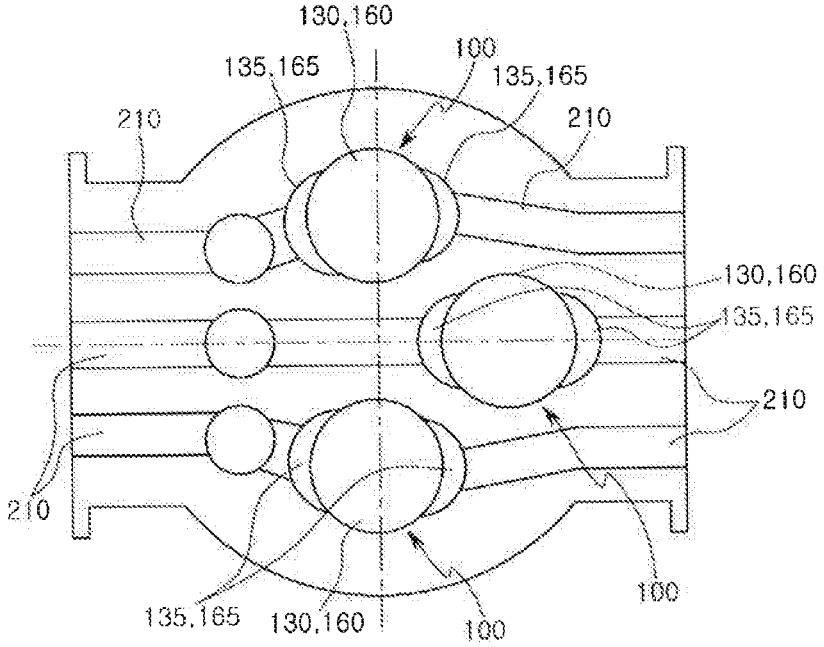
FIG. 5 is a plan view illustrating an example of a gas-insulated circuit breaker applied to a three-phase batch type circuit breaker.

Meanwhile, as illustrated in FIG. 5, the first extension part 135 is protruded in the longitudinal direction of the bus bars 210 connected to the fixed-side conductor 130 and the movable-side conductor 160 and the second extension part 165 is protruded in the longitudinal direction of the bus bars 210 connected to the fixed-side conductor 130 and the movable-side conductor 160.

That is, the first extension part 135 and the second extension part 165 are only protruded in the longitudinal direction of the bus bars 210. Therefore, the body portions of the fixed-side conductor 130 and the movable-side conductor 160, except for the first extension part 135 and the second extension part 165, do not protrude on the outer surface.

In this case, the first extension part 135 and the second extension part 165 are only protruded in an equal phase and are not protruded in other phases in the three-phase batch type circuit breaker. Through this structural feature, it is possible to secure an insulation distance between the phases.

As set forth above, according to an exemplary embodiment of the present disclosure, having such a configuration, effects of cooling a high temperature insulation gas that has extinguished an arc may be improved.

While exemplary embodiments have been shown and described above, it will be apparent to those skilled in the art that modifications and variations could be made without departing from the spirit and scope of the present disclosure as defined by the appended claims.

What is claimed is:

1. A gas-insulated circuit breaker comprising:

a fixed contact having a hollow formed therein;

a fixed arc contact disposed in the hollow of the fixed contact;

a fixed-side conductor provided to surround the fixed contact and configuring a gap between the fixed-side conductor and the fixed contact as a discharge path for an insulation gas;

a movable contact having a hollow formed therein;

a movable arc contact disposed in the hollow of the movable contact;

a movable-side conductor provided to surround the movable contact and configuring a gap between the movable-side conductor and the movable contact as a discharge path for an insulation gas;

a first extension part formed on the fixed-side conductor and extending some section of the discharge path for the insulation gas of the fixed-side conductor to lower a pressure of the insulation gas flowing into the discharge path of the fixed-side conductor; and a second extension part formed on the movable-side conductor and extending some section of the discharge path for the insulation gas of the movable-side conductor to lower a pressure of the insulation gas flowing into the discharge path of the movable-side conductor, wherein, the first extension part is integrally formed with the fixed-side conductor, so that a main current flows through the first extension part, wherein, the second extension part is integrally formed with the movable-side conductor, so that the main current flows through the second extension part, wherein the fixed-side conductor and the movable-side conductor have a bus bar constituting the main current conduction path, wherein, the fixed-side conductor has a cylindrical shape in which at least one first extension part is formed on a side of the fixed-side conductor, and the movable-side conductor has a cylindrical shape in which at least one second extension part is formed on a side of the movable-side conductor, wherein, the first extension part is formed by protruding a portion of an outer circumferential surface of the fixed-side conductor in a radial direction with respect to the fixed-side conductor, and wherein, the second extension part is formed by protruding a portion of an outer circumferential surface of the movable-side conductor in a radial direction with respect to the movable-side conductor.

2. The gas-insulated circuit breaker of claim 1, wherein the fixed-side conductor and the movable-side conductor have discharge apertures in front ends thereof, the discharge apertures allowing the insulation gas to be discharged outwardly there through.

3. The gas-insulated circuit breaker of claim 1, further comprising: a puffer cylinder in the movable contact, the puffer cylinder spraying the insulation gas into a gap between the fixed arc contact and the movable arc contact according to an operation of separating the movable contact from the fixed contact.

* * * * *